United States Patent [19]

Lassiter

[11] Patent Number: 5,010,904

[45] Date of Patent: Apr. 30, 1991

[54] METHOD AND APPARATUS FOR DETECTING LOOSE ENDS OF CIGARETTES

[75] Inventor: Wallace R. Lassiter, Winston-Salem, N.C.

[73] Assignee: R. J. Reynolds Tobacco Company, Winston-Salem, N.C.

[21] Appl. No.: 454,208

[22] Filed: Dec. 21, 1989

[51] Int. Cl.[5] ..... A24C 5/32; A24C 5/34

[52] U.S. Cl. ..... 131/280; 131/905; 131/906; 131/908; 250/223 R

[58] Field of Search ..... 131/280, 94, 281, 905, 131/907, 908; 356/445, 237, 446, 447, 432; 250/223 R

[56] References Cited

U.S. PATENT DOCUMENTS

| | | | |
|---|---|---|---|
| 2,861,683 | 11/1958 | Gilman . | |
| 3,368,674 | 2/1968 | Koeppe . | |
| 3,993,194 | 11/1976 | Reuland . | |
| 4,011,950 | 3/1977 | McLoughlin et al. . | |
| 4,277,678 | 7/1981 | Wahle et al. . | |
| 4,377,743 | 3/1983 | Bolt et al. . | |
| 4,424,443 | 1/1984 | Reuland . | |
| 4,496,055 | 1/1985 | Green et al. . | |
| 4,616,139 | 10/1986 | Heitmann . | |
| 4,645,921 | 2/1987 | Heitmann et al. . | |
| 4,678,901 | 7/1987 | Focke et al. . | |
| 4,766,910 | 8/1988 | Okumoto . | |
| 4,805,641 | 2/1989 | Radzio et al. | 131/280 |
| 4,844,100 | 7/1989 | Holznagel . | |
| 4,907,607 | 3/1990 | Fock et al. | 131/280 |
| 4,931,633 | 6/1990 | Fock et al. | 250/223 R |
| 4,944,314 | 7/1990 | Bolt | 131/280 |
| 4,955,948 | 9/1990 | Fock et al. | 131/280 |

FOREIGN PATENT DOCUMENTS

| | | | |
|---|---|---|---|
| 3243204 | 5/1984 | Fed. Rep. of Germany | 131/280 |

OTHER PUBLICATIONS

"Proscan" data sheet; Hauni Richmond Inc.; and Proscan User's Manual, pp. 1, 2 and 62-63, Software—Version 1.73, Feb. 25, 1988, Hauni Item No. 322 216 0-001.

*Primary Examiner*—V. Millin
*Assistant Examiner*—Lynne A. Reichard
*Attorney, Agent, or Firm*—Grover M. Myers

[57] ABSTRACT

The invention is directed to an inspection method, apparatus and system for identifying cigarettes having insufficient tobacco at their lighting end in which cigarettes are conveyed serially through a beam of infrared radiation. The amount of infrared radiation passing perpendicularly through the end portion of each cigarette is compared to a predetermined value to determine whether or not the cigarette is defective. The method, apparatus and inspection system of the invention is both accurate and reliable and can be employed in combination with cigarette manufacturing systems operating at speeds in excess of 7,000-8,000 cigarettes per minute.

44 Claims, 3 Drawing Sheets

METHOD AND APPARATUS FOR DETECTING LOOSE ENDS OF CIGARETTES

FIELD OF THE INVENTION

The invention relates to a method and apparatus for identifying cigarettes having insufficient tobacco at their lighting end. More specifically, the invention relates to a method and apparatus for identifying cigarettes having insufficient tobacco at their lighting end either during or after the manufacturing process.

BACKGROUND OF THE INVENTION

Loose ends on cigarettes are a source of dissatisfaction and complaints from smokers. A "loose end" is an end of a cigarette which is insufficiently filled with tobacco. When the tobacco in the end of a cigarette is too loosely packed or has too low a packing density, tobacco particles and shreds can fall out of the end of the cigarette as it is removed from the pack. Moreover, a cigarette having a loose end can be difficult to light uniformly and the burning of the cigarette, at least during the initial puffs, may not be uniform. Cigarettes therefore undergo one or more tests during the manufacturing process in order to identify and reject cigarettes having loose ends.

A variety of techniques have been used to identify loose ends on cigarettes. Manually, in an off line method, cigarettes can be examined by an expert viewing the ends of the cigarette along their longitudinal axis. Automated techniques include mechanical testing such as pin insertion into the cigarette end optical testing where special optics are used to view and examine the end of a cigarette; and electrical techniques for examining the electrical properties of the cigarette end.

For example, U.S. Pat. No. 3,368,674 to Koeppe describes a method and apparatus for testing the ends of cigarettes by inserting a pin into the end of a cigarette. If the end is too soft, the pin extends excessively into the cigarette end. The pin insertion method has inherent mechanical limitations and cannot, for example, be used in conjunction with modern, high speed cigarette manufacturing operations.

A more recent method and apparatus for testing the end portions of cigarettes is described in U.S. Pat. No. 3,993,194. This apparatus, which is employed commercially in the industry involves capacitive sensing of the density at the end of the cigarette. The end of the cigarette is passed in close proximity to the electrodes of a capacitor. The change in the electric field is measured to provide an indication of the tobacco density at the end of the cigarette. Such capacitive inspection of cigarettes can be conducted at high speeds. But this testing method can be influenced by various extraneous factors such as relative humidity in the manufacturing environment, varying amounts of moisture in the tobacco, and/or differing types of tobaccos in the tobacco blend, leading to inaccuracies in the proper identification of cigarettes having loose ends.

U.S. Pat. No. 4,496,055 to Green et al. describes an optical method for identifying cigarettes having loose ends. Cigarettes are passed through a channel including a pair of photoelectric cells which direct light, preferably of the infrared spectrum, radially inwardly into the tobacco tip of the cigarette. A fiber optic detector perpendicular to the end of the cigarette measures the infrared light reflected from the end of the cigarette along its longitudinal axis to thereby distinguish between cigarettes having ends properly filled with tobacco and those having ends insufficiently filled with tobacco. The insufficiently filled cigarettes are rejected. In this device, the distance between the end of the cigarette and the fiber optic detector is an important parameter and a potential source of inaccuracy. Similarly, cigarettes having a loose end portion but with substantial amounts of tobacco shreds at only the end, per se, of the cigarette, may not be identified as defective.

The above and other processes and apparatus have been and are used commercially to test the tobacco ends of cigarettes as they are conveyed serially during the manufacturing process. Because of various difficulties such as those identified above, and others, none of the commercially available on-line systems for detecting loose ends have proven to be satisfactorily accurate and reliable over the long term in the manufacturing environment. For example, with some systems cigarettes having loose ends are not properly identified and rejected. With other systems, properly manufactured cigarettes, having satisfactorily filled ends are nevertheless rejected. Some systems suffer both such shortcomings.

In most cigarette manufacturing processes, loose end inspection is conducted at at least two locations. The first inspection is conducted on individual cigarettes, just after their manufacture. The cigarettes are thereafter inspected downstream, as a group, during the packaging or packing operation where groups of typically, 20, cigarettes are packed into a package. A single cigarette having a loose end when identified first at the packing stage of manufacture, results in the rejection of an entire cigarette package, thus causing the rejection of 19 satisfactory cigarettes along with the 1 defective cigarette. In addition to waste of satisfactory cigarettes, this results in waste of satisfactory packaging materials.

As cigarette manufacturing speeds have increased from several thousand cigarettes per minute to 8,000 or more cigarettes per minute, the accuracy of tobacco end inspection systems has decreased. Thus, despite the continual and well recognized need for improved cigarette end inspection systems, and despite continuing efforts to improve these systems, there is still no commercially available inspection system which has been found to be both highly accurate and reliable in the manufacturing environment.

SUMMARY OF THE INVENTION

In accordance with the invention there is provided an improved inspection system for cigarettes for identifying loose ends, i.e. cigarette ends containing insufficient tobacco. The method of the invention is accomplished by conveying a plurality of cigarettes serially along a predetermined path of travel with the cigarettes being oriented transversely to the path of travel and so that the tobacco filled ends of the cigarette are on one side of the path. The predetermined path of travel includes an inspection zone wherein a beam of infrared radiation, i.e., infrared light, is passed transversely through a portion of each cigarette adjacent the tobacco filled end of the cigarette. The intensity of the infrared light passing through each cigarette end portion is sensed. The cigarettes are determined to be defective and preferably rejected, if the amount of infrared light passing transversely through the cigarette end portion is greater than a predetermined value.

The apparatus of the invention includes a conveyor means for serially conveying a plurality of cigarettes along a predetermined path of travel. The cigarettes are oriented transversely to the direction of travel so that tobacco filled ends of the cigarettes pass serially along one side of the conveying means. An inspection means is fixedly positioned along the path of travel adjacent the one side of the conveyor and includes an infrared emitter and an infrared receiver. The emitter and the receiver are aligned with each other on opposites sides of, and spaced from, the path of travel so that the tobacco filled end portions of the cigarettes serially pass between the emitter and the receiver. The amount of infrared light passing through the end portion of each cigarette is analyzed in a comparator means to determine whether the cigarette is defective.

The method and apparatus of the invention provide for substantially instantaneous inspection of cigarette ends. Even when a narrow infrared beam is passed through only a portion of the cigarette end, the method and apparatus of the invention are both reliable and accurate. The inspection system of the invention is substantially insensitive to ambient moisture in the manufacturing environment and to the amount of moisture in the tobacco. The inspection system of the invention is substantially insensitive to minor tobacco blend changes. In addition, the system is reliable and accurate at low speeds and at high speeds. It can thus be used during high speed manufacturing processes in which cigarettes are manufactured at speeds in excess of 7,000–8,000 cigarettes per minute.

The inspection system of the invention does not rely upon examination of the cut end, per se, of the cigarette; instead, infrared light is passed transversely through a small portion of the cigarette end. Because there is no need to examine the end, per se, of the cigarette, the method and apparatus of the invention can be provided in a simpler form and construction, without the need to provide complicated systems for inspecting the entire cut end of the cigarette from its longitudinal axis. In addition, since the end, per se, of the cigarette is not examined, the method and apparatus of the invention are not significantly influenced by slight changes in cigarette position on the conveyor. In this regard, those systems which examine the cut end of the cigarette can be significantly influenced by slight changes in cigarette position on the conveyor. Thus, in the capacitive sensing system, the same cigarette will give a different reading if the cigarette end is spaced 0.5 mm from the capacitor than if the cigarette is spaced 1.0 mm from the capacitor. And such can be the case when the cigarettes are not identically located on a cigarette manufacturing conveyor such as a fluted, rotary drum. Similarly, in the systems where the cigarette end is examined optically, spacing between the cigarette end and the optical detector will influence the results of inspection. Significantly, these differences in inspection results due to minor changes in cigarette placement on the conveyor can be minimized or eliminated by use of the subject invention. Thus, in accordance with this invention, it has been found that a defective cigarette can be identified regardless of whether the cigarette is examined for example, 2 mm, or 3 mm, from its cut end.

The method and apparatus of the invention can readily be carried out in combination with rotary conveyors such as are typically used in cigarette manufacturing processes and apparatus. Apparatus embodiments of the invention are small and can readily be combined with commercially available cigarette manufacturing apparatus without the need for substantial modification thereof. Nevertheless, the inspection system of the invention is reliable and can provide significantly greater accuracies than prior commercial systems.

BRIEF DESCRIPTION OF THE DRAWINGS

In the drawings which form a part of the original disclosure of the invention.

DETAILED DESCRIPTION OF THE PREFERRED EMBODIMENTS

In the following detailed description, various preferred embodiments of the invention are described. It is to be understood however, that the invention is not to be limited to its preferred embodiments; to the contrary, the invention includes various alternatives, modifications and equivalents within its spirit and scope as will be apparent to the skilled artisan.

Figure 1:
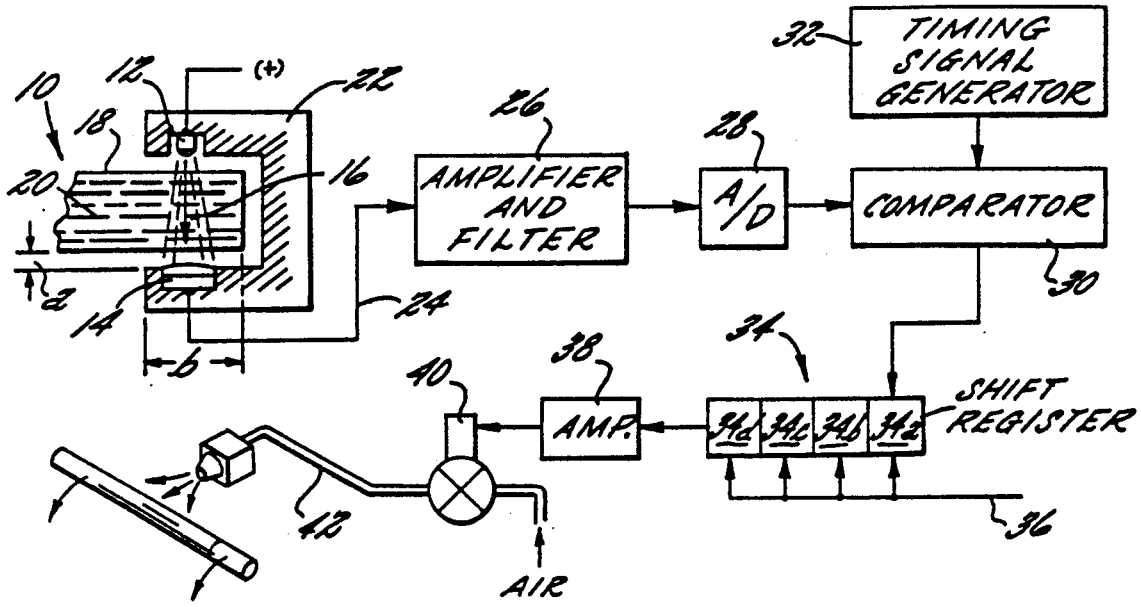
FIG. 1 schematically illustrates the process and apparatus of the invention.

In the process and apparatus of the invention cigarettes are individually conveyed so that the tobacco filled end of each cigarette passes between an infrared emitter or source, and a detector. FIG. 1 schematically illustrates a preferred process and apparatus embodiment of the invention. A tobacco filled cigarette end 10 is shown passing between an infrared emitter 12 and an infrared detector 14. The cigarette is carried by any of various conveyor systems such as that illustrated in FIGS. 3–5 and discussed in detail hereinafter. Returning to FIG. 1, a beam of infrared light 16 is shown passing through cigarette paper 18 and tobacco 20 and then being received by detector 14. The emitter and the detector are held in substantial alignment by a bracket 22 and are each spaced at a distance, A, of between, for example, 0.1 and 2 mm from the radial edges of the cigarette. Preferably, this spacing will be between about 0.25 and about 1.5 mm. A portion of the end of the cigarette constituting between about 2 and about 10 mm, preferably between about 3 and about 7 mm is inserted into the bracket so that the infrared light beam 16 passes through a portion of the end of the cigarette between about 1 mm and 10 mm, preferably between about 2 mm and about 6 mm from the end of the cigarette.

The signal from infrared detector 14 is passed via wire 24 to an amplifier and filter 26, wherein the signal is first amplified. The signal is filtered to remove various periodic electrical signals or "noise" which is generated by the conveyor (not shown) or the cigarette manufacturing equipment (not shown) which are concurrently transporting the cigarette through the inspection system.

The thus amplified and filtered signal is next passed to convertor 28 wherein the analog signal is converted into a digital signal. The digital signal is sent to a comparator 30 which may also receive input from a timing signal generator 32 which, in turn, generates a signal each time a cigarette moves through a cigarette manufacturing or conveying apparatus for synchronization of the inspection system with the conveying system. In comparator 30, the digital signal from converter 28 is compared to a predetermined value. The predetermined value employed in comparator 30 is an experimentally determined value and will be dependent on the strength of the IR source, sensitivity of the IR detector and amplification of the resultant signal as will be apparent to the skilled artisan. In addition, the value used in the comparator may be different for different types of cigarettes. Thus, for example a lower value will be used with a dense tobacco blend, and a higher value will be used with a low density or highly puffed tobacco. If the signal is less than the predetermined value, cigarette 10 is satisfactory. If the signal is greater than the predetermined value, the cigarette is determined to be defective and a defect signal is supplied to shift register 34. The defect signal is transferred from one shift register stage 34*a*, to the next stage, 34*b*, and so on, in synchronism with the application of shift signals to the shift signal input 36 of the shift register. When the defect signal reaches the last shift register stage, it is applied to the input of an amplifier 38 and then in amplified form to the winding of an electromagnetic valve 40. This causes valve 41 to open, permitting pressurized air to pass through conduit 42 and emerge as a blast of air which expels a defective cigarette having a loose end. The shift register 34 provides the proper time delay corresponding to the time required for the defective cigarette to pass from the infrared examination stage to the location at which it should be ejected.

Figure 2:
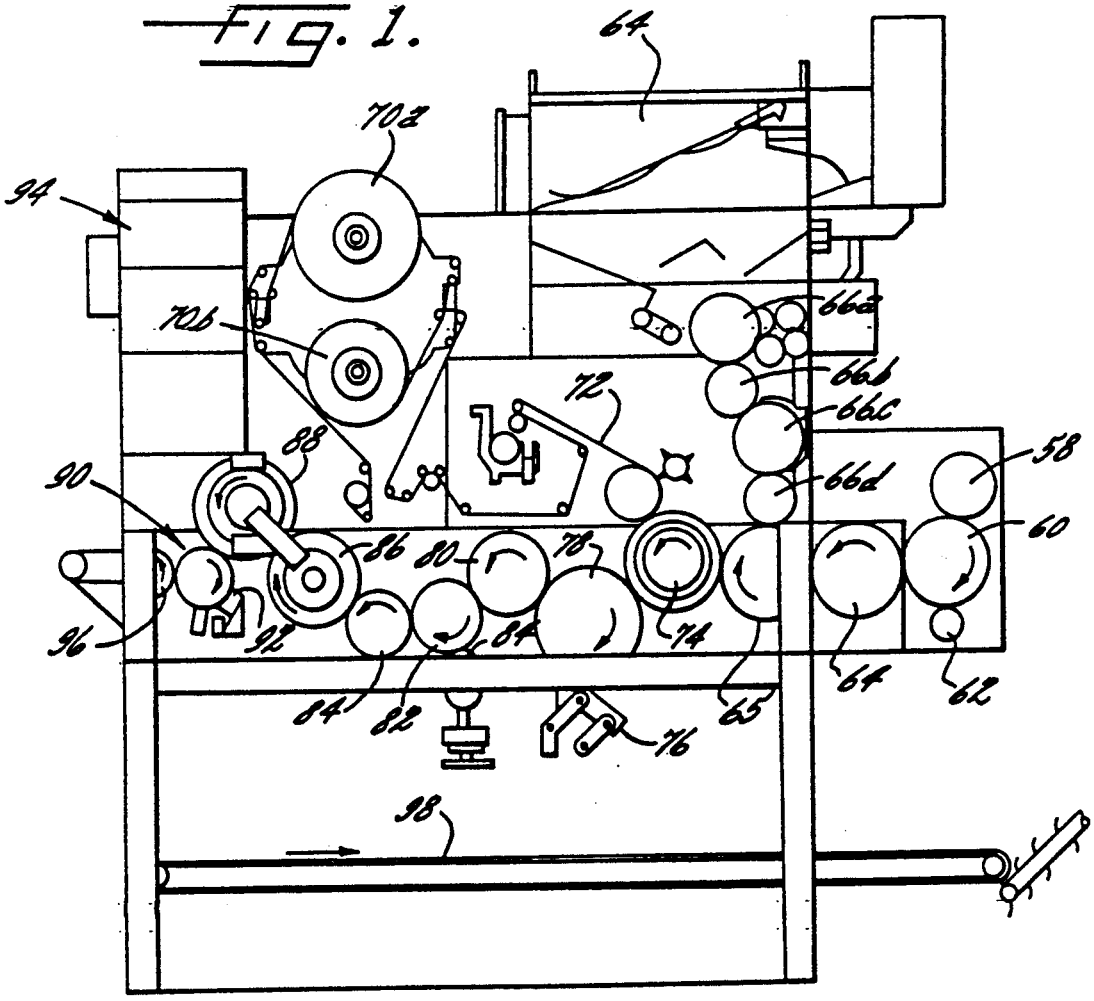
FIG. 2 is a schematic illustration of a cigarette manufacturing apparatus and illustrates one preferred location for the inspection process and apparatus of the invention.

FIG. 2 illustrates schematically a well known filter cigarette making or tipping machine which can assemble plain cigarette rods of single length with filter mouthpieces of double unit length to form filter cigarettes of double unit length, and which thereupon converts each filter cigarette of double unit length into two filter cigarettes of single unit length. Such apparatus is known and sold commercially by Hauni-Werke Korber and Co., KG, Hamburg, Germany. The apparatus generally includes a rotary conveyor 58 which receives double length tobacco rods from an upstream rod forming apparatus (not shown). The double length tobacco rods are carried by rotary drum 60 across rotary cutter 62 which cuts the double length tobacco rods into single length tobacco rods. The cut rods are passed to rotary drum 64 where each pair of freshly cut, abutting single length rods are spread apart longitudinally to provide room between the aligned rods for a double length filter. A plurality of filters of six unit length are maintained in reservoir 64 and are cut and fed via rotary cutters and conveyors 66*a*, 66*b*, 66*c*, and 66*d* to drum 65 where double unit length filters are inserted into the longitudinal space between each pair of axially aligned, single length tobacco rods. Paper bobbins 70*a* and 70*b* supply double width tipping paper 72 to rotary drum 74 for the application of tipping paper to the middle of the double unit cigarettes. The tipping paper is rolled around the cigarettes on rotary drum 78 employing a special rolling block 76 to thereby join the double filter to the two tobacco rods to form the double unit cigarettes. The double unit cigarettes are then passed via rotary drum 80 to rotary drum 82 where rotary knives 84 are employed to cut each double unit cigarettes at its center to thereby provide single unit cigarettes. A special turning unit made up of drums 84, 86 and 88 turns every other cigarette so that drum 90 receives a single row of filter cigarettes of unit length wherein all filters face in the one direction and all tobacco filled ends of the cigarettes face in the opposite direction. Drum 90 conveys the cigarette past inspection unit 92. Reject signals are sent to machine control section 94 which additionally supplies timing signals for rejection of defective cigarettes on drum 96. Rejected cigarettes are carried by conveyor 98 to a reclaiming operation.

Figure 3:
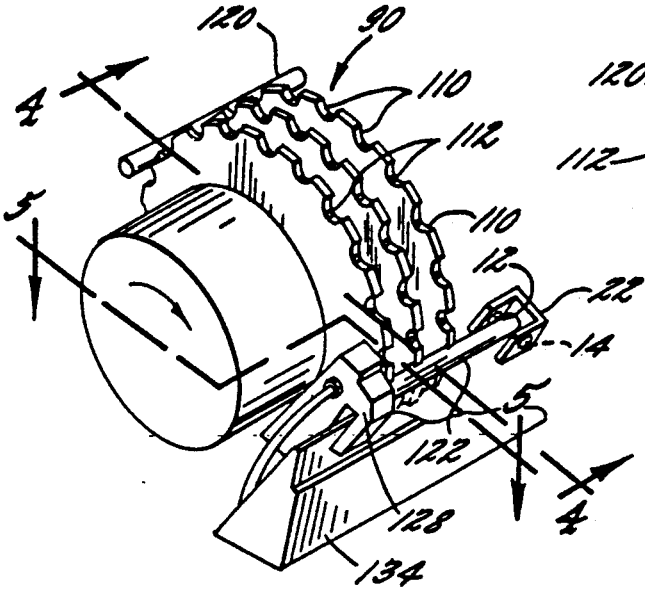
FIG. 3 is a perspective view of one preferred apparatus embodiment of the invention.
Figure 5:
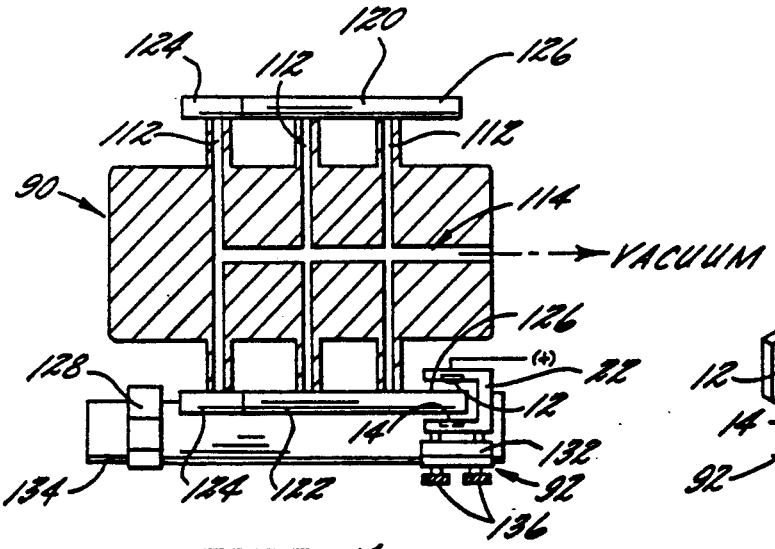
FIG. 5 is a top cross sectional view of the apparatus of FIG. 3 taken substantially along line 5—5.

FIG. 3 is an exploded view, taken in perspective, of rotary drum 90 and includes the loose end inspection system of this invention. A particularly preferred apparatus embodiment of this invention is shown. Rotary drum includes a plurality of flutes 110, each of which include a bore connected to a vacuum source (not shown) via a central bore 114 (FIG. 5) in the center of rotary drum 90. Two cigarettes 120 and 122 are shown carried by the flutes of the rotary drum. Those skilled in the art will recognize that in the cigarette manufacturing operation each of the flutes of drum 90 will carry a cigarette. As best seen in FIG. 5, each of the cigarettes have a filter end 124 and a tobacco end 126, and the cigarettes are oriented so that the tobacco ends are all on the same side of the rotary conveyor.

As the cigarettes are carried in a clockwise direction on the rotary conveyor, the tobacco filled ends thereof pass between infrared emitter 12 and detector 14. The emitter and detector are carried by bracket 22 so that theY are maintained in substantial alignment with each other. At the same time the filter ends of the cigarettes are passed across a conventional missing filter detector 128.

Figure 4:
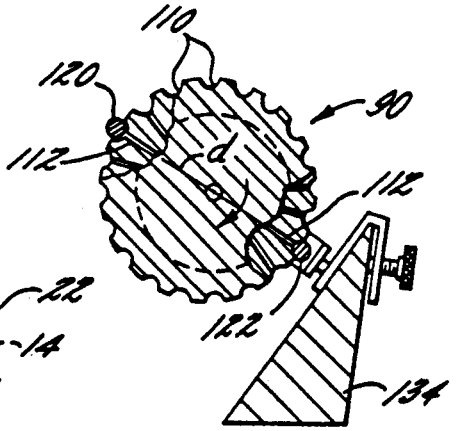
FIG. 4 is a side cross sectional view of the apparatus of FIG. 3 taken substantially along line 4—4.

As best seen in FIG. 4, the emitter 12 and the detector 14 are in substantial alignment along a diameter, d, of rotary conveyor 90 so that the end of cigarette 122 passes through a beam of infrared light which is substantially perpendicular to the tangential path of the cigarette. Bracket 22, which is generally U-shaped, thus positions the infrared emitter and detector adjacent the path of travel of the cigarettes while maintaining each of the emitter 12 and detector 14 spaced from the path of travel of the cigarette ends, on opposite sides thereof.

Figure 6:
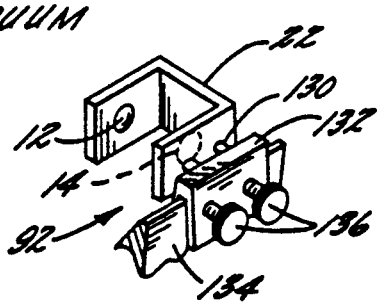
FIG. 6 is an exploded view of a portion of the inspection apparatus illustrated in FIG. 3.

An enlarged view of the inspection apparatus is shown in FIG. 6. U-shaped bracket 22 is connected via a plurality of rods 130 to a second bracket 132 which is slidably mounted on support 134. Thumb screws 136 are provided for locking bracket 132 at the desired location with respect to the cigarette end. Thus, with reference to FIG. 5, bracket 132 can be moved to the left or to the right on support 134 in order to adjust the position of emitter and detector 12 and 14, respectively with respect to end 126 of cigarette 122.

Any of various infrared emitters may be used in the process and apparatus of the invention. Advantageously, a high power output IR emitter having an output greater than 100 milliamps is employed. For example, a high powered GaAlAs IR emitter having an output of 880 nanometers (nm.) non-coherent infrared radiant energy emission with a 50 mW power output has been successfully employed. Such emitter has an overall diameter of about 8.25 mm and is commercially available from OPTO DIODE CORPORATION, 750 Mitchell Road, Newbury Park, Calif. 91320, under the designation OD50L. Other wavelengths of infrared radiation can be successfully used in the method and apparatus of this invention. Advantageously the emission is within a narrow spectral region of between about 800 and about 900 nm. However, light of 860–900 nm nanometers is particularly preferred.

A preferred IR detector which can be employed as detector 14, is one which preferably has a built-in amplifier section. Advantageously, the detector will be of the high-speed, solid state silicon photodiode type. By employing a built-in operational amplifier, low-level measurements can be made while ensuring low-noise output under a variety of operating conditions. The detector can be extremely small, for example, having an active surface area of less than about 10–15 $mm^2$, for example, about 5 $mm^2$, and an active diameter of less than about 4 mm, for example, about 2–2.5 mm. The detector must be sensitive to the IR emission of the emitter. One detector which has been successfully employed herein is commercially available from United Detector Technology, 12525 Chardron Avenue, Hawthorne, California 90250-9964, under the designation Photops UDT-451. This detector has a responsivity of 0.5 amps/watt at 850 nm.; a breakdown voltage of 50 volts; an operating temperature range of 0°–70 C.; a supply voltage of $\pm 15$ volts; a slew rate of 13 $\mu$/us and an open loop gain (DC) of 200 V/mV. It will be apparent that preferred detectors should have a high sensitivity for the wavelength of IR light being emitted by the emitter.

It will be apparent that fiber optics may be substituted in bracket 22 for either or both of emitter 12 and/or detector 14, in which event the IR emitter and or receiver are provided at a remote location and are optically connected to the optical fibers which are provided in bracket 22.

Although illustrated in connection with a rotary conveyor employed in the cigarette manufacturing process, this invention, as will be recognized by the skilled artisan, can also be used in various other environments for serially inspecting tobacco ends of cigarettes. Thus, the apparatus may be employed in connection with a linear conveyor including for example, a channel where cigarettes are gravity fed, located prior to a packer operation where cigarettes are packed into packages. If desired, the inspection may be conducted in an off-line environment on selected cigarettes in order to provide an indication of percentages of cigarettes having loose ends being manufactured, i.e. for quality control inspection purposes. Various other brackets and support arrangements may be provided for the IR receiver and emitter combination which will allow tobacco ends of cigarettes to pass between the IR emitter and detector without interfering with the conveyance of the cigarettes. Special lenses may be provided on the IR emitter in order to focus the IR emission into a narrow beam or in order to broaden the width of the IR beam.

As previously indicated, the system of the invention is advantageously employed in combination with a reject means for rejecting cigarettes having loose ends. However, the system of the invention is also advantageously employed in combination with systems wherein signals from the inspection system are used to modify operation of a cigarette manufacturing operation, i.e., in feed forward or feedback systems such as described, for example, in U.S. Pat. No. 4,844,100 to Holznagel in which cigarette end inspection signals are employed to adjust the location of a densifying station in a cigarette rod manufacturing process.

Figure 7:
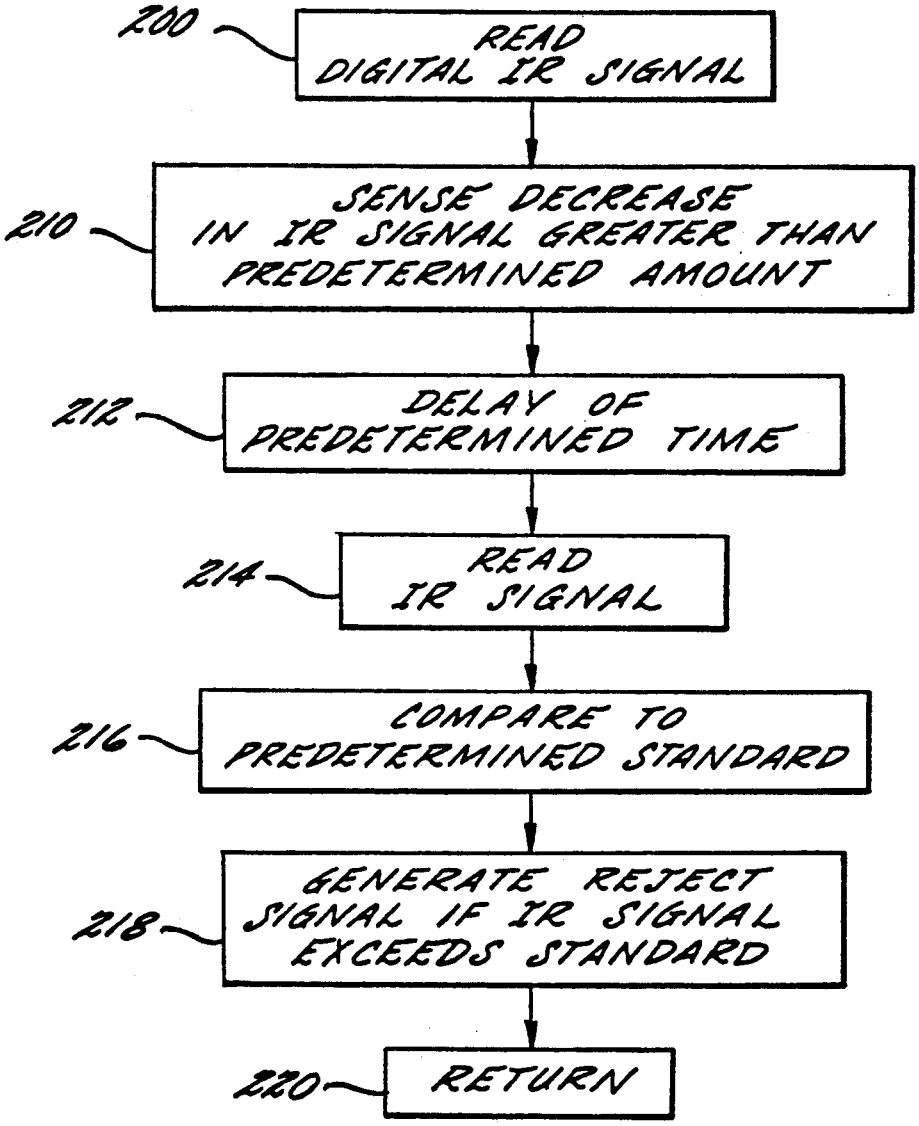
FIG. 7 schematically illustrates one preferred method and control system useful the invention.

One preferred control system for the method and apparatus of the invention is schematically illustrated in FIG. 7. Such control system is advantageously implemented by a conventional microcomputer system. A continuous IR signal is emitted by an IR emitter and continuously detected by an IR detector. The signal is amplified, filtered and converted into a digital signal representative of the intensity of infrared light being received by the IR detector. The digital signal is continuously received and read as indicated in block 200 of FIG. 7. As a cigarette end passes between the IR emitter and the detector, the digital signal will decrease in amplitude by a significant amount. When such a decrease in the signal strength is identified, as shown in block 210, an indication is thus provided that a cigarette is beginning to enter into the IR beam. No special part detect is needed in accordance with this preferred aspect of the invention since by continuously monitoring the signal strength, the emitter and detector, themselves, operate as a part detect. Any of various control methods can be employed for determining signal strength decrease. Advantageously a single reading is compared to a predetermined experimental value or to a predetermined value representing the average value of several previous readings. Similarly, an average of several current readings may be compared to an average of several previous readings.

Upon identification of decrease in the signal greater than the predetermined amount, control of the system is passed to block 212 wherein a predetermined delay is provided, depending on the rate of travel of the cigarette. If the system is being employed with a conveyor having varying operating speeds, the delay time of block 212 is calculated as a function of the conveyor speed. If the conveyor is operating at a single, preset speed, for example, 7,200 cigarettes per minute, only a set, predetermined time delay is employed. In either case, sufficient time delay is employed to allow sufficient transverse movement of the cigarette so that a major portion of the cigarette is located between the IR emitter and the IR detector. Following the time delay, control is passed to block 214. In this step, the IR signal is read to obtain a sample signal representative of the amount of IR light passing through a cigarette end. The signal may be read only a single time, or advantageously, a plurality of e.g., from 2–10 readings, are obtained and averaged to provide a single reading representative of the intensity of IR light passing through the cigarette tip or end.

A reading having been obtained in block 214, control is then passed to block 216 where the value or amplitude of the sampled signal is compared to a second predetermined value. If the value of the sampled signal obtained in block 214 is less than the second predetermined value, this indicates that the cigarette is satisfactory. If the value of the sampled signal obtained in block 214 is greater than the second predetermined value, too much infrared radiation has passed through the cigarette end, indicating a defective cigarette and control passes to block 218 where a defect signal is generated. Advantageously, the defect signal will comprise a reject signal and the reject signal then is synchronized with a timing signal from the rotary conveyor. The defective cigarette is rejected at a downstream location.

Following generation of either the reject signal or the determination earlier that the cigarette is satisfactory, system control is passed to block 220 for return to block 200 wherein the above sequence is repeated with the next cigarette on the conveyor.

It will be understood b those having skill in the art that control systems other than those described in FIGS. 1 and 7 may be employed, according to the invention, to detect loose ends. For example, the digital control system of FIG. 1 may be replaced by an analog control system. In one example of an analog system, A/D converter 28, comparator 30, timing signal generator 32 and shift register 34 (FIG. 1) may be replaced with analog components. Analog differentiators ma be employed to detect the local minima in the detected IR signal, and the signal voltage at each local minima may be compared to a preset voltage to identify loose ends. An analog delay unit may apply the loose end signal to valve 40 after an appropriate delay.

Alternatively, digital control systems other than that described in FIG. 7 may also be employed. For example, loose end detection may be triggered by detecting a local minimum in the digitized IR signal, rather than by sensing a decrease in the IR signal greater than a predetermined amount. In this alterative, block 212 of FIG. 7 is replaced with a block which detects a difference between adjacent samples of the digital signal which is less than a predetermined amount, to indicate that a local minimum has occurred. Alternatively, digital differentiation techniques may be used. Compared to the technique of FIG. 7, these alternative techniques have the advantage that speed variations in the conveying system are automatically accommodated.

It can thus be seen that the method and apparatus of the invention provides a cigarette inspection system wherein cigarettes having end portions having insufficient tobacco are detected by passing an infrared beam transversely through the end of the cigarette. The inspection system of the invention can be employed in combination with high speed conveying of cigarettes since the passage of infrared light through cigarette end is accomplished virtually instantaneously. Since the end of the cigarette, itself, is not examined transversely along the longitudinal axis of the cigarette, slight variations in the lateral location of the cigarette on the conveyor have an insignificant impact on the inspection system. By proper choice of the infrared light, a wavelength of infrared light can be employed which is not influenced by humidity in the tobacco or in the ambient atmosphere. Apparatus embodiments of the invention, as illustrated, are compact and can readily be employed in connection with commercially available cigarette manufacturing equipment.

The invention has been described in considerable detail with reference to its preferred embodiments. However, variations and modification can be effected within the spirit and scope of the invention as described in the foregoing specification and defined in the appended claims.

What is claimed is:

1. An apparatus for identifying cigarettes having loose ends comprising:

conveyor means for serially conveying a plurality of cigarettes along a path of travel with the cigarettes being oriented transversely to the direction of travel so that tobacco filled ends of the cigarettes pass serially along one side of the conveying means; and inspection means fixedly positioned along the path of travel adjacent the one side of the conveyor and comprising an infrared emitter and an infrared receiver, the emitter and receiver being aligned with each other on opposite sides of, and spaced from, the path of travel so that tobacco filled end portions of the cigarettes serially pass between the emitter and the receiver.

2. The apparatus of claim 1 additionally comprising a rejection means responsive to the inspection means for rejecting cigarettes having loose ends.

3. The apparatus of claim 1 additionally comprising a signal receiving means for receiving signals from the infrared detector and a comparator means for comparing the value of the signals to a predetermined value.

4. The apparatus of claim 3 additionally comprising converting means for converting received signals from the infrared receiver into digital signals, and wherein said comparator means comprises digital comparator means for comparing the converted digital signals to a predetermined digital value.

5. The apparatus of claim 2 wherein the emitter and receiver are each spaced from the path of travel at a distance of between about 0.1 and 2.0 millimeters.

6. The apparatus of claim 4 wherein the receiver and the emitter are each spaced a distance of from about 0.25 to about 1.5 millimeters from the path of travel.

7. The apparatus of claim 1 wherein the conveyor means comprises a rotary drum conveyor.

8. The apparatus of claim 7 wherein the emitter and the receiver are in substantial alignment along a diameter of the rotary conveyor so that the cigarette end portion passes through a beam of infrared radiation which is substantially perpendicular to the tangential path of the cigarette.

9. The apparatus of claim 1 wherein the infrared emitter emits infrared radiation within a narrow spectral region of between about 860–900 nanometers.

10. The apparatus of claim 1 wherein said infrared receiver comprises an infrared detector having an active surface area of less than about 10 square millimeters.

11. A method for inspecting the end portions of cigarettes comprising:

conveying a plurality of cigarettes serially along a predetermined path of travel comprising an inspection zone, the cigarettes being oriented transversely to the path of travel and so that the tobacco filled ends of the cigarettes are on one side of the path of travel, the inspection zone being on the one side of the path of travel and comprising an infrared emitter and an infrared receiver in alignment on opposite sides of the path of travel;

passing a beam of infrared radiation transversely through an end portion of each cigarette adjacent the tobacco filled end thereof as the cigarettes are serially conveyed through the inspection zone and between the aligned infrared emitter and receiver; and sensing the intensity of infrared radiation passing through the end portion adjacent the end of each of the plurality of cigarettes.

12. The method of claim 11 additionally comprising the step of comparing a value representative of the sensed amount of infrared radiation to a predetermined value.

13. The method of claim 12 additionally comprising the step of rejecting the cigarette hen the value representative of the sensed amount of infrared radiation is greater than the predetermined value.

14. The method of claim 11, 12 or 13 wherein the method is conducted during the cigarette manufacturing process.

15. The method of claim 14 wherein the cigarette manufacturing process is operated at a speed greater than about 7,000 cigarettes per minute.

16. The method of claim 11 wherein the beam of infrared radiation is passed through a portion of the tobacco filled end of the cigarette located at a distance of from about 1 to about 5 millimeters from the end of the cigarette.

17. The method of claim 11 wherein the conveying step comprises conveying cigarettes along a curved path.

18. The method of claim 11 wherein the beam of infrared radiation has a narrow spectral width of between about 860–900 nanometers.

19. The method of claim 17 wherein the conveying step comprises conveying the cigarettes along a linear path of travel.

20. An inspection system for identifying cigarettes having loose ends comprising:

conveying means for conveying cigarettes serially through an inspection zone, the inspection zone comprising an infrared emitter oriented to pass infrared radiation transversely through an end portion of each cigarette and an infrared detector aligned with the emitter and oriented to receive the infrared light passing transversely through the end portion of each cigarette; control means for the inspection system comprising:

receiving means for receiving an inspection signal representative of the intensity of infrared radiation being received by the infrared detector;

first comparator means for comparing the inspection signal to a first predetermined value;

generating means responsive to the first comparator means for generating an initiation signal if the inspection signal is less than the first predetermined value;

sampling means responsive to the generating means for obtaining a sample signal from the receiving means at a predetermined time after the inspection signal, the sample signal being representative of the intensity of infrared radiation passing through a cigarette; and second comparator means for comparing the sample signal to a second predetermined value.

21. The inspection system of claim 20 wherein the control means additionally comprises a reject signal generating means for generating a reject signal when the sample signal is greater than the second predetermined value.

22. The inspection system of claim 20 wherein the first predetermined value is representative of the average value of a plurality of prior inspection signals.

23. The inspection system of claim 20 wherein the inspection signal compared in the first comparator means is representative of an average of a plurality of inspection signals from the receiving means.

24. The inspection system of claim 20 wherein the predetermined time after the inspection signal is determined based on the speed of the conveying means.

25. The inspection system of claim 20 wherein the sample signal obtained in the sampling means is representative of the average of a plurality of inspection signals from the receiving means.

26. The inspection system of claim 20 wherein the cigarettes are conveyed on said conveying means at a speed in excess of 7,000 cigarettes per minute.

27. The inspection system of claim 20 wherein the control means comprises a microcomputer system.

28. An inspection system for identifying cigarettes having loose ends comprising:

conveying means for conveying cigarettes serially through an inspection zone, the inspection zone comprising an infrared emitter oriented to pass infrared radiation transversely through an end portion of each cigarette and an infrared detector aligned with the emitter and oriented to receive the infrared light passing transversely through the end portion of each cigarette; control means for the inspection system comprising:

receiving means for receiving an inspection signal representative of the intensity of infrared radiation being received by the infrared detector;

local minimum detecting means for detecting a local minimum value of the inspection signal; and comparator means for comparing the local minimum value of the inspection signal to a predetermined value.

29. The inspection system of claim 28 wherein said local minimum detecting means and said comparator means comprise digital local minimum detecting means and digital comparator means, respectively.

30. The inspection system of claim 28 wherein said local minimum detecting means and said comparator means comprise analog local minimum detecting means and first analog comparator means, respectively.

31. The inspection system of claim 28 wherein the control means additionally comprises a reject signal generating means for generating a reject signal when the sample signal is greater than the second predetermined value.

32. The inspection system of claim 28 wherein the cigarettes are conveyed on said conveying means at a speed in excess of 7,000 cigarettes per minute.

33. The inspection system of claim 28 wherein the control means comprises a microcomputer system.

34. An apparatus for manufacturing cigarettes at a speed in excess of 7000 cigarettes per minute comprising means for receiving tobacco rods of double unit length;

means for cutting each double unit length rod into two axially aligned single unit length tobacco rods;

means for inserting a double unit length filter between the two axially aligned, single unit length tobacco rods;

means for joining the double unit filter to the two single unit tobacco rods to thereby form a double unit length cigarette;

means for cutting each double unit cigarette at its center to form single unit length cigarettes;

means for orienting the single unit length cigarettes in a like direction so that the tobacco filled ends of the cigarettes face in the same direction;

conveying means for conveying the like oriented cigarettes at a speed in excess of 7000 cigarettes per minute; and inspection means positioned adjacent the conveying means and comprising an infrared emitter oriented to pass infrared radiation transversely through an end portion of each cigarette on the conveying means and an infrared receiver aligned with the emitter and oriented to receive the infrared light passing transversely through the end portion of each cigarette.

35. The apparatus of claim 34 additionally comprising a rejection means responsive to the inspection means for rejecting cigarettes having loose ends.

36. The apparatus of claim 34 additionally comprising a signal receiving means for receiving signals from the infrared detector and a comparator means for comparing the value of the signals to a predetermined value.

37. The apparatus of claim 34 additionally comprising converting means for converting received signals from the infrared receiver into digital signals, and wherein said comparator means comprises digital comparator means for comparing the converted digital signals to a predetermined digital value.

38. The apparatus of claim 34 wherein the emitter and receiver are each spaced from the path of travel at a distance of between about 0.1 and 2.0 millimeters.

39. The apparatus of claim 34 wherein the conveyor means comprises a rotary drum conveyor.

40. The apparatus of claim 39 wherein the emitter and the receiver are in substantial alignment along a diameter of the rotary conveyor so that the cigarette end portion passes through a beam of infrared radiation which is substantially perpendicular to the tangential path of the cigarette.

41. A method for manufacturing cigarettes at a speed in excess of 7000 cigarettes per minute comprising the steps:

conveying double unit length tobacco rods at a speed in excess of 3500 rods per minute;

cutting the double unit length tobacco rods into pairs of axially aligned single unit length tobacco rods;

inserting a double unit length filter between each pair of axially aligned single unit length tobacco rods;

joining each double unit filter to each pair of single unit tobacco rods to thereby form double unit length cigarettes;

cutting each double length cigarette at its center to form single unit length cigarettes;

orienting the single unit length cigarettes in a like direction so that the tobacco filled ends of the cigarettes face in the same direction;

conveying the like oriented cigarettes at a speed in excess of 7000 cigarettes per minute along a predetermined path of travel through an inspection zone comprising an infrared emitter and an infrared receiver in alignment on opposite sides of the path of travel so that the tobacco filled ends of the cigarettes serially pass between the aligned infrared emitter and receiver;

passing a beam of infrared radiation transversely through the end portion of each cigarette adjacent the tobacco filled end thereof as the cigarette is conveyed through the inspection zone and between the aligned infrared emitter and receiver; and sensing the intensity of infrared radiation passing transversely through each cigarette.

42. The method of claim 41 additionally comprising the step of comparing a value representative of the sensed amount of infrared radiation to a predetermined value.

43. The method of claim 42 additionally comprising the step of rejecting the cigarette when the value representative of the sensed amount of infrared radiation is greater than the predetermined value.

44. The method of claim 41 wherein the beam of infrared radiation is passed through a portion of the tobacco filled end of the cigarette located at a distance of from about 1 to about 5 millimeters from the end of the cigarette.

* * * * *